US006874440B1

(12) United States Patent
Manderfeld

(10) Patent No.: US 6,874,440 B1
(45) Date of Patent: Apr. 5, 2005

(54) EXPANDABLE MULTI-HULL BOAT

(76) Inventor: Raymond M. Manderfeld, 50600 Wyandotte Dr., Granger, IN (US) 46530

( * ) Notice: Subject to any disclaimer, the term of this patent is extended or adjusted under 35 U.S.C. 154(b) by 0 days.

(21) Appl. No.: 10/272,717

(22) Filed: Oct. 17, 2002

Related U.S. Application Data

(60) Provisional application No. 60/343,072, filed on Dec. 20, 2001.

(51) Int. Cl.[7] ..... B63B 1/00
(52) U.S. Cl. ..... 114/61.18
(58) Field of Search ..... 114/61.15, 61.16, 114/61.17, 61.18, 61.19, 352, 354, 61.1, 61.22, 114/85, 123

(56) References Cited

U.S. PATENT DOCUMENTS 3,139,058 A * 6/1964 Robinson ..... 114/61.17
3,925,837 A * 12/1975 Miller ..... 114/352
4,909,169 A * 3/1990 Skandaliaris et al. .... 114/61.18
5,265,550 A * 11/1993 Harper, Jr. ..... 114/61.16
5,829,376 A * 11/1998 Kostanski ..... 114/61.1
5,868,032 A * 2/1999 Laskey ..... 74/89.37
6,003,458 A * 12/1999 Valliere ..... 114/61.18
6,178,913 B1 * 1/2001 Brignolio ..... 114/353
6,397,769 B1 * 6/2002 Bullmer ..... 114/61.1

FOREIGN PATENT DOCUMENTS

SU 524728 A * 4/1977

* cited by examiner

*Primary Examiner*—Andrew D. Wright

(57) ABSTRACT

A boat having at least two hulls with an adjustable frame which maintains the relative separation of the hulls. Each hull having one or more buoyancy sections. Each buoyancy section of each hull may be relocated laterally, by expansion or contraction of an adjustable frame which causes the relative separation of corresponding buoyancy sections to be controllably adjusted. Accordingly, both deck area of the boat and its stability are increased when the buoyancy sections are extended laterally.

5 Claims, 5 Drawing Sheets

EXPANDABLE MULTI-HULL BOAT

CROSS REFERENCE TO RELATED APPLICATION

This is a continuation of provisional application Ser. No. 60/343,072 filed Dec. 20, 2001.

BACKGROUND OF THE INVENTION

1. Field of Invention

The present invention relates generally to a boat and in particular to an expandable multi-hull boat such as a pontoon boat.

2. Description of Related Art

Multi-hull boats are well known and can trace their origin to primitive vessels made by securing two logs together for added stability and deck area. Stability and increased deck area are preferable in boats. However, naval architects must sacrifice the benefits of a wide beam boat which provides such stability and increased deck area to accommodate limitations such as are imposed by transportation and docking considerations. By way of example many states impose strict limitations on transporting boats wider than eight and a half feet on roadways.

SUMMARY OF THE INVENTION

Accordingly, there is a need for a boat with a beam which can be widened when added stability and/or usable deck area are desirable, but which allows the beam to be narrowed when convenient for other purposes. The present invention meets this previously unmet need and provides several related advantages by expandable framing disposed between the hulls of a multi-hull boat.

DESCRIPTION OF THE PREFERRED EMBODIMENT

Figure 1:
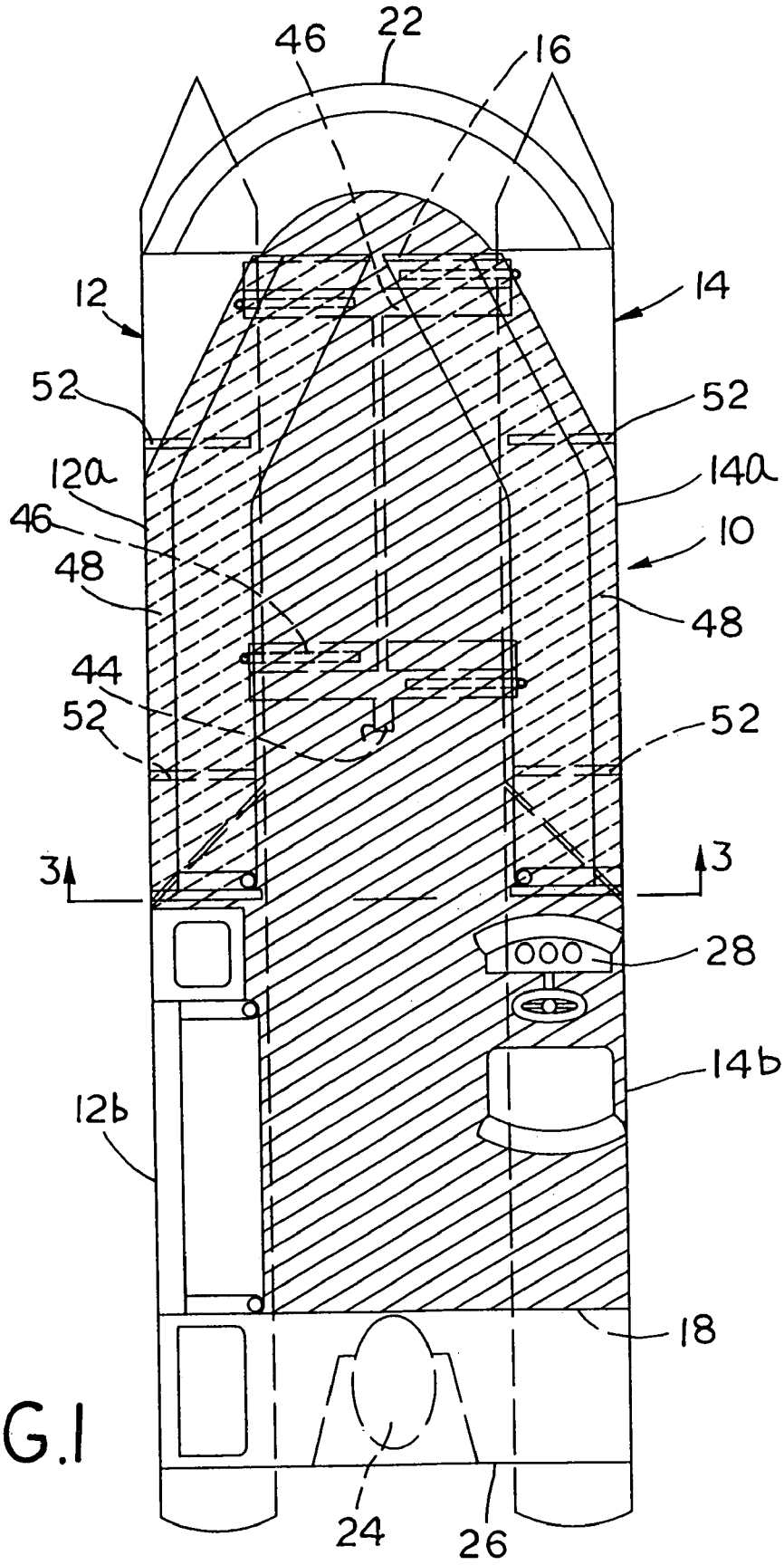
FIG. 1 is a plan view of a multi-hull boat 10 with bow buoyancy sections 12*a* and 14*a* laterally retracted.

Referring to the drawings, the present invention relates to an improved multi-hull boat 10 which includes port hull 12 and starboard hull 14. Port hull has a bow buoyancy section 12*a* and a stern buoyancy section 12*b* and starboard hull 14 has a bow buoyancy section 14*a* and a stern buoyance section 14*b*. Adjustable frame 16 is disposed between and controllably maintains the adjustable separation between bow buoyancy sections 12*a* and 14*a*. Fixed frame 18 is disposed between and preferably maintains the separation between stern buoyancy sections 12*b* and 14*b* at a fixed distance. Deck 20 is supported upon fixed frame 18 and adjustable frame 16. A propulsion motor 24 is attached to the fixed frame at the stern 26 of the multi-hull boat and pilot station 28 is located upon the deck 20. Preferably, port hull 12 and hull 14 each have two buoyancy sections, but it should be appreciated that the present invention can include a port and starboard hull each incorporating a single buoyancy section or more than two buoyancy sections.

FIG. 1 shows bow buoyancy sections 12*a* and 14*a* in their retracted positions which thus provides the minimum beam 30 for the boat. The bow buoyancy sections' intermediary ends 32 and stern buoyancy sections' intermediary ends 34 are preferably configured to minimize hydrodynamic drag. The intermediary ends are shown with surfaces angled so the leading edges (closest to the bow 22) are inboard and the trailing edges (closest to the stern 26) are outboard. It should be appreciated that the intermediary ends can also be configured in other ways to minimize hydrodynamic drag such as locating the leading edge at the top of the buoyancy section and locating the trailing edge at the bottom of the buoyancy section. In still another configuration the bow buoyancy section intermediary end can be shaped as a stern end of a pontoon and stern buoyancy section intermediary end can be shaped as a bow end of a pontoon, both of which are well known by one skilled in the art.

Adjustable frame 16 is disposed so as to controllably maintain the desired relative separation between bow buoyancy sections 12*a* and 14*a*. Preferably, fixed frame 18 is not expandable thus, the separation between stern buoyancy sections 12*b* and 14*b* is fixed. However, it should be appreciated that an adjustable frame can be substituted for the fixed frame so as to allow the separation between stern buoyancy sections to be controllably changed. Likewise, in still another configuration each hull can have a single buoyancy section with separation between the hulls adjustable.

Figure 2:
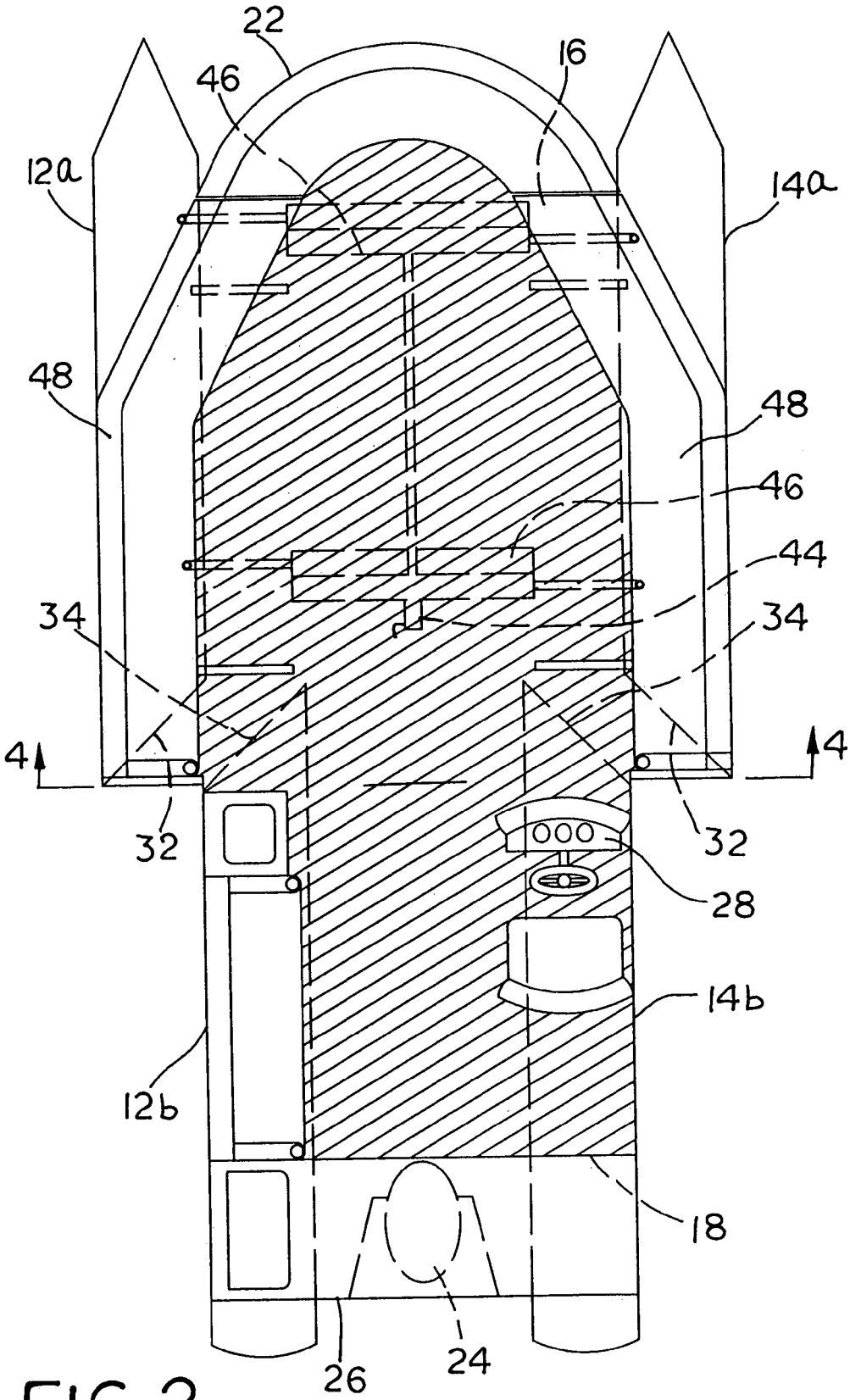
FIG. 2 is a plan view of the multi-hull boat 10 with bow buoyancy sections 12*a* and 14*a* shown in their laterally extended position.

Referring to FIG. 2, preferably, a central motor 44 located under deck 20 is configured to synchronously operate ball recirculating drives 46 to expand and contract the adjustable framing 16 which in turn shifts the bow buoyancy sections 12*a* and 14*a* between their retracted (FIG. 1) and extended (FIG. 2) position. It should be recognized that other drive mechanisms well known in the art which can mechanically expand and contract the adjustable frame, such as a rack and pinion, could be substituted for the ball recirculating drives.

Figure 4:
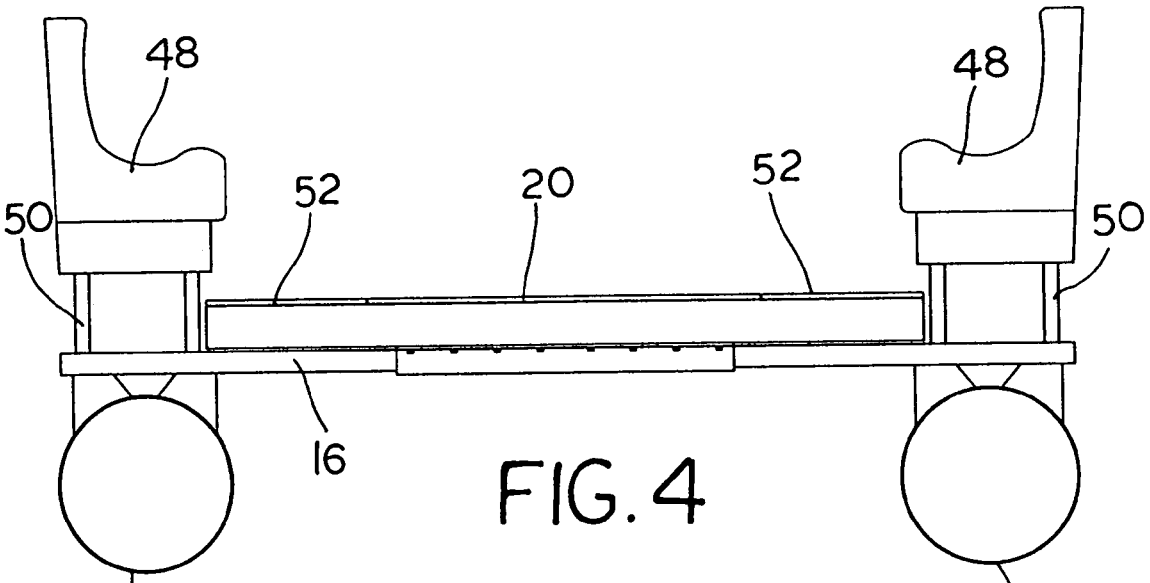
FIG. 4 is a fragmentary sectional view along line 4—4 of FIG. 2, showing bow buoyancy sections 12*a* and 14*a* in their laterally extended position.
Figure 3:
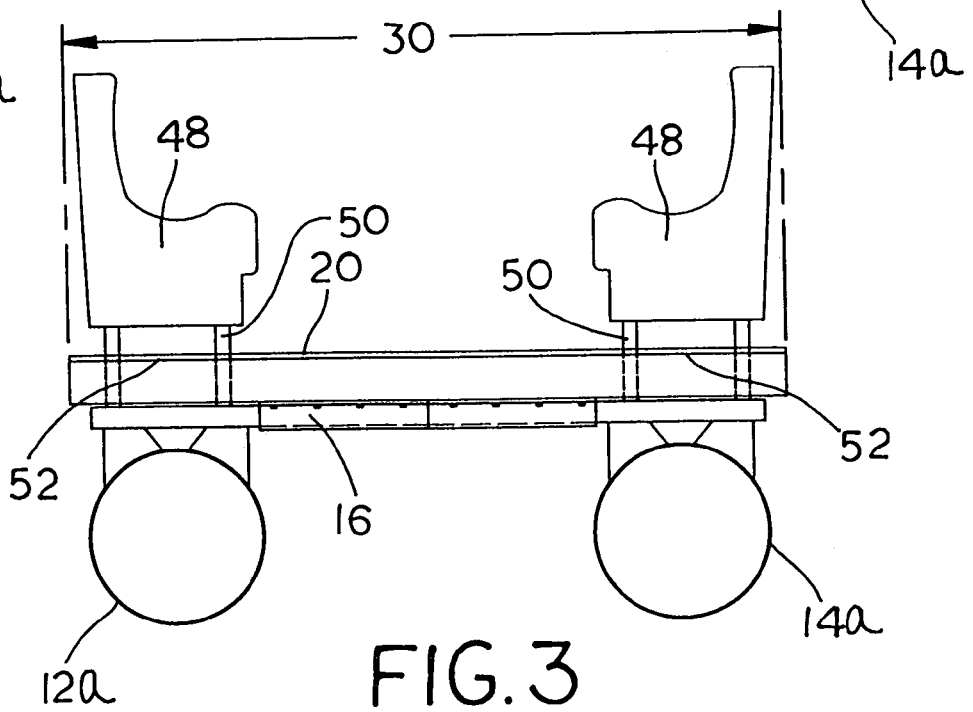
FIG. 3 is a fragmentary sectional view along line 3—3 of FIG. 1, showing bow buoyancy sections 12*a* and 14*a* in their laterally retracted position.
Figure 5:
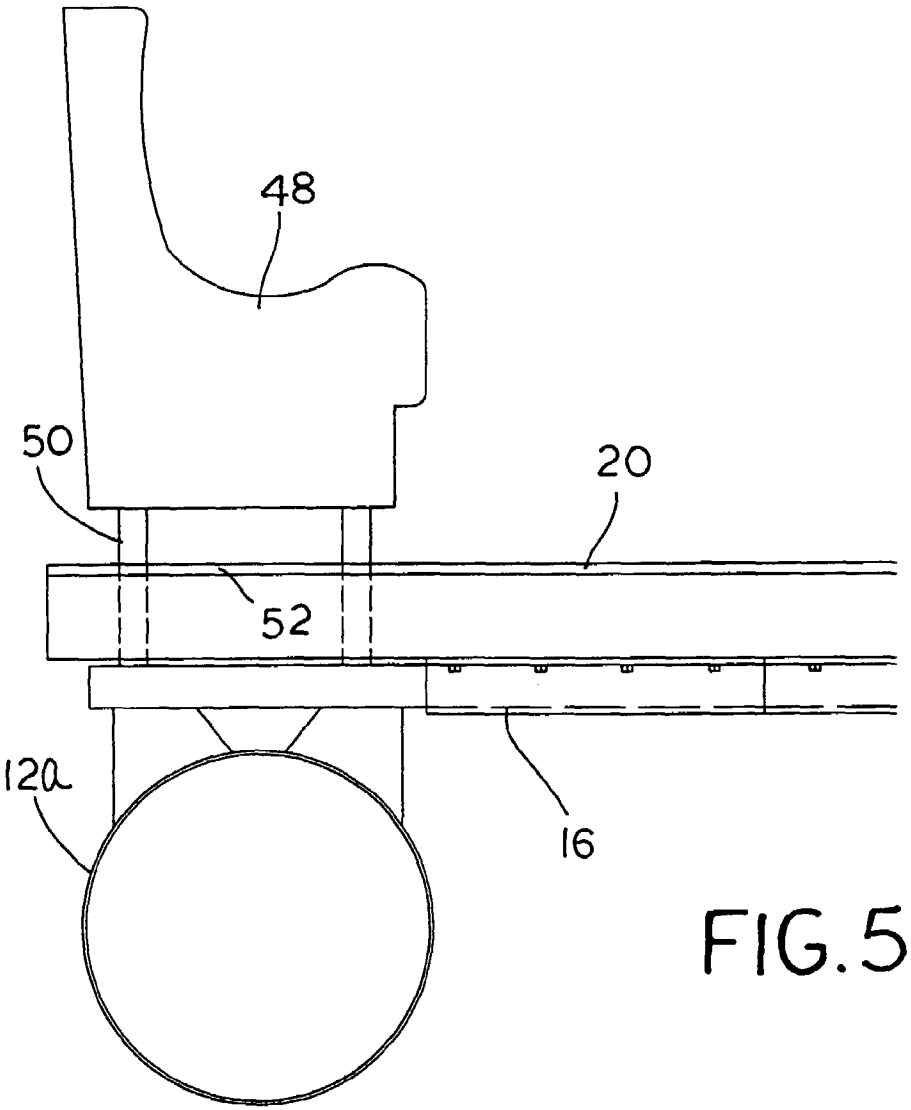
FIG. 5 is an enlarged portion of FIG. 3 showing a sectional view of bow buoyancy section 12*a* in its laterally retracted position.
Figure 6:
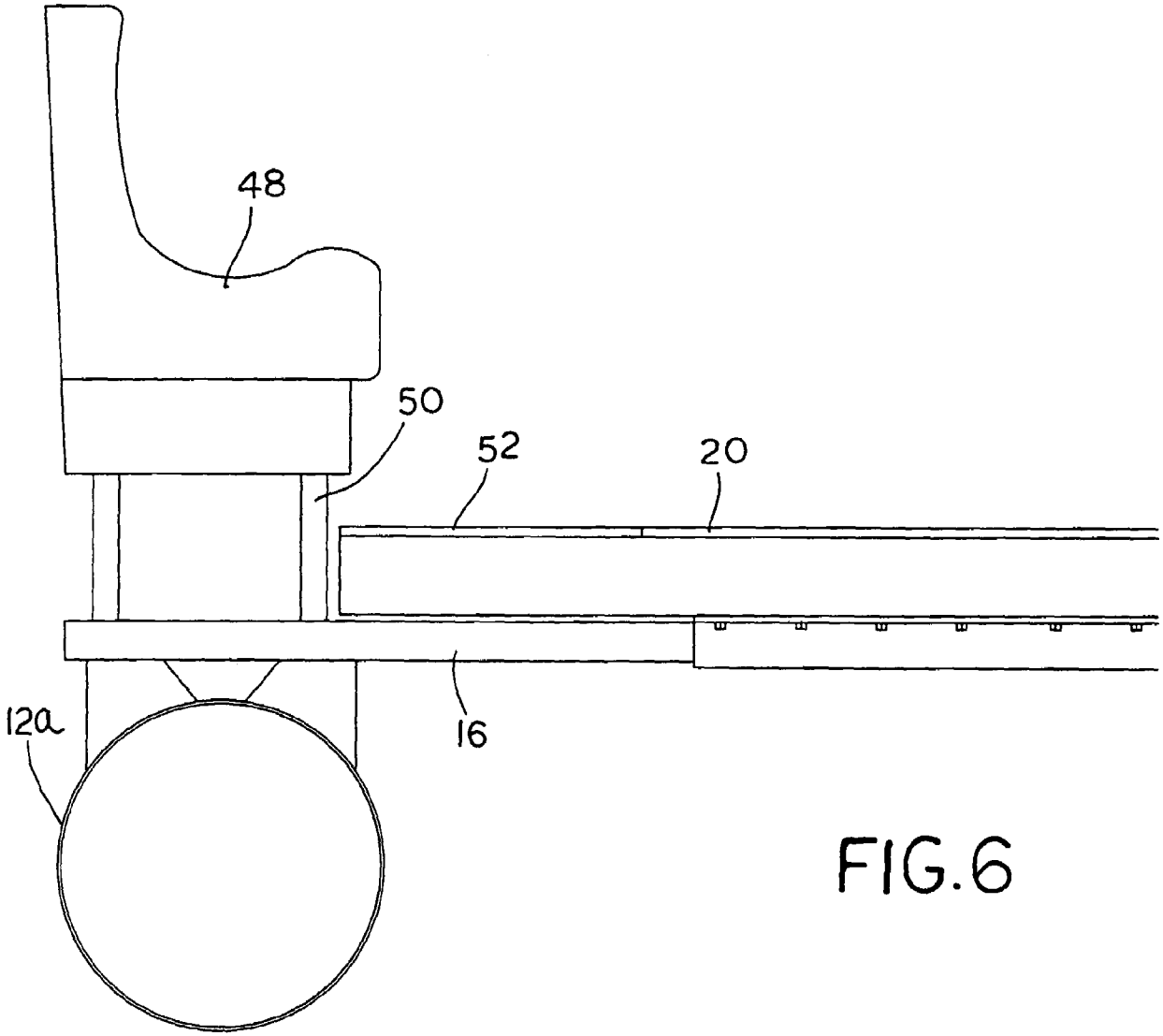
FIG. 6 is an enlarged portion of FIG. 4 showing a sectional view of bow buoyancy section 12*a* in its laterally extended position.

Referring to FIGS. 3, 4, 5, and 6, deck components, such as containers or seat cushions 48 are attached to bow buoyancy sections 12*a* and 14*a* by seat supports 50. Deck slots 52 allows the deck 20 to freely pass the seat supports as the beam 30 of the boat is expanded or retracted. Referring to FIGS. 3 and 4, the deck 20 remains in a fixed position relative to the center line of the boat 10 while bow buoyancy sections 12*a* and 14*a* are extended and retracted. When bow buoyancy sections 12*a* and 14*a* are retracted and expanded, seat cushions 48 slide over deck 20 with the deck slots 52 allowing the free passage of the seat supports 50.

This invention is not to be limited to the details above described but it may be modified within the scope of the following claims.

I claim:

1. A multi-hull boat comprising two hulls, each hull having a buoyancy section, a deck disposed upon said hulls, a frame supporting said deck and connected to said hulls, said frame being extendable relative to said deck for shifting said hulls between a laterally extended position and laterally retracted position, a drive connected to said frame for shifting said hulls between their said extended and retracted positions, a deck component connected to said frame and being shiftable with the frame between inward and outward positions relative to said deck, said deck having a slot, said component including a support part extending through and above said deck at said slot, said support part forming a seat and being connected to said frame and shiftable along said slot as said hulls are shifted between their extended and retracted positions.

2. The boat of claim 1 wherein said drive is a ball recirculating drive and includes a motor for actuating the ball recirculating drive.

3. The boat of claim 1 wherein said deck is located between said deck component and said frame.

4. A multi-hull boat comprising two hulls, each hull having a buoyancy section, each said buoyancy section of each hull including a bow section and a separate stern section, a deck disposed upon said hulls, a first frame supporting said deck and connected to said bow section of each hull, a fixed frame supporting said deck and connected to the stern section of each hull, said first frame being extendable relative to said deck for shifting said bow sections of said hulls relative to the stern sections between a laterally extended position and laterally retracted position, a drive connected to said first frame for shifting said bow sections of said hulls between their said extended and retracted positions.

5. A multi-hull boat comprising two hulls, each hull having a buoyancy section, each said buoyancy section of each hull including a bow section and a separate stern section, a deck disposed upon said hulls, a shiftable frame supporting said deck and connected to said bow section of each hull, a fixed frame supporting said deck and connected to the stern section of each hull, said shiftable frame being extendable relative to said deck for shifting said bow sections of said hulls relative to said stern sections between an outwardly extended position laterally offset from said stern sections and a retracted position aligned with said stern sections, a drive connected to said shiftable frame for shifting said bow sections of said hulls between their extended and retracted positions.

* * * * *